United States Patent [19]

McClure

[11] 4,092,872

[45] June 6, 1978

[54] SAFETY ATTACHMENT FOR THE HORSEHEAD OF AN OIL WELL PUMPING UNIT

[76] Inventor: L. C. McClure, P.O. Box 505, Midland, Tex. 79701

[21] Appl. No.: 703,551

[22] Filed: Jul. 1, 1976

[51] Int. Cl.[2] ..... F16H 21/32

[52] U.S. Cl. ..... 74/41; 74/551

[58] Field of Search ..... 74/548, 41, 551.1

[56] References Cited

U.S. PATENT DOCUMENTS

| | | | |
|---|---|---|---|
| 1,738,855 | 12/1929 | Thompson | 74/551.1 |
| 2,199,583 | 5/1940 | Athy | 74/41 |
| 2,215,224 | 9/1940 | MacMillian | 74/548 |

*Primary Examiner*—Benjamin W. Wyche
*Assistant Examiner*—Wesley S. Ratliff, Jr.
*Attorney, Agent, or Firm*—Clarence A. O'Brien; Harvey B. Jacobson

[57] ABSTRACT

An attachment for the horsehead of an oil well pump jack or pumping unit including a pair of strap assemblies oriented in spaced, generally parallel relation to each other with each strap assembly including two components hingedly connected to each other with each strap component including means adjustably securing it to the opposite sides of the horsehead with such means also enabling detachable connection between either of the strap components and the horsehead so that the attachment may be used for various purposes during repair, maintenance and the like and also serve as a retaining device for the wire line assembly which extends from the wire line hanger at the upper corner of the horsehead to the polished rod.

4 Claims, 7 Drawing Figures

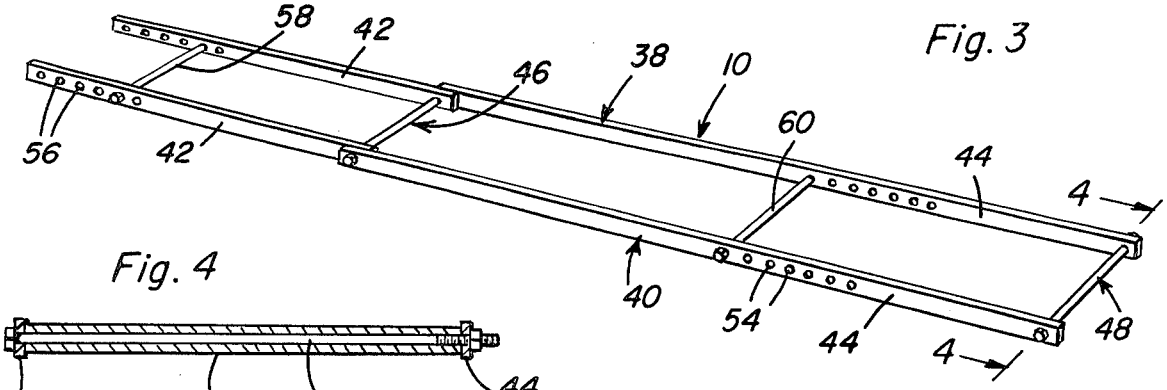
Fig. 3
Fig. 4
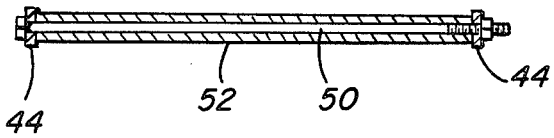
Fig. 5
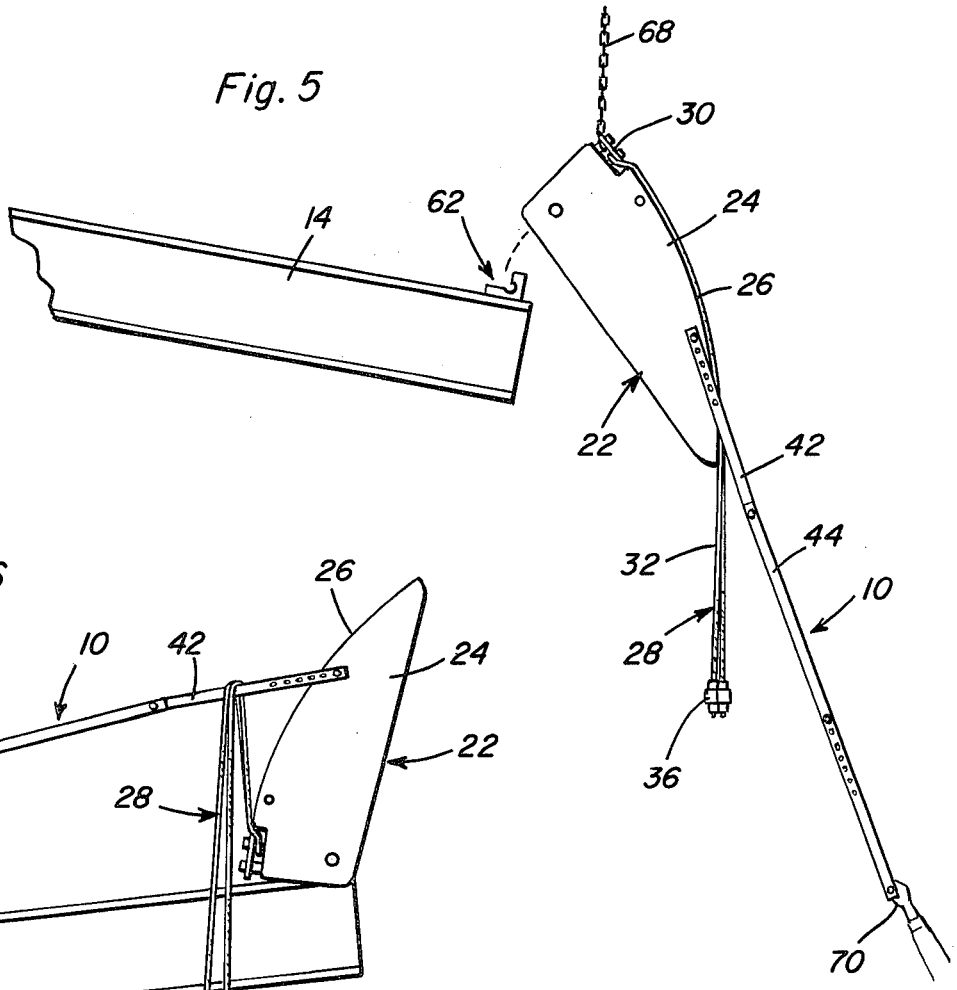
Fig. 6
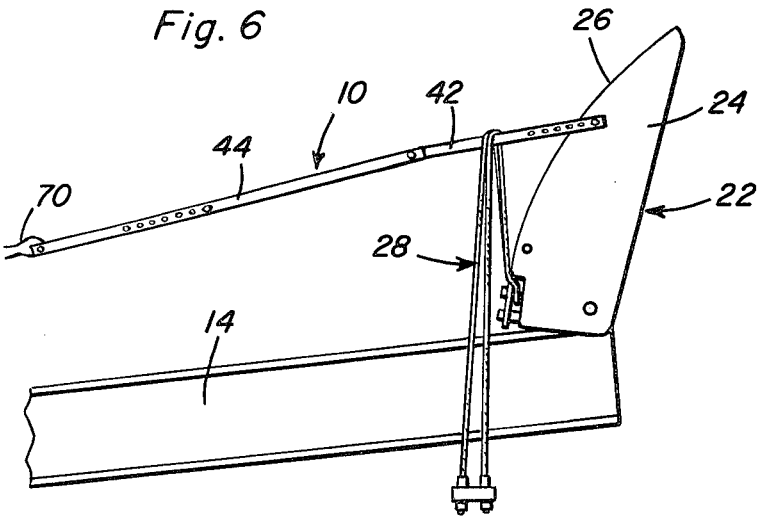
Fig.7
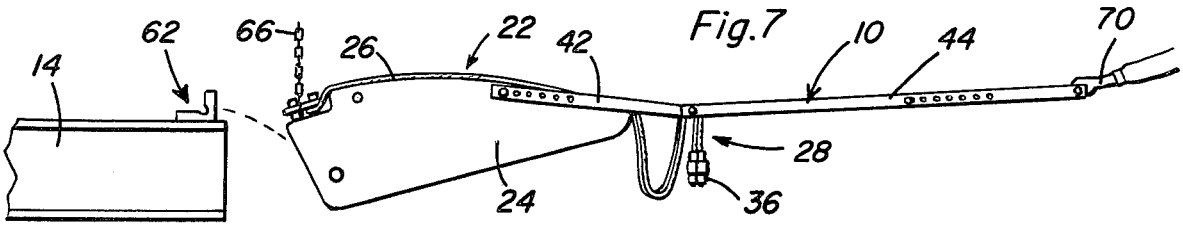

SAFETY ATTACHMENT FOR THE HORSEHEAD OF AN OIL WELL PUMPING UNIT

BACKGROUND OF THE INVENTION

1. Field of the Invention

The present invention generally relates to an attachment for the horsehead of an oil well pump jack or pumping unit and more particularly a pair of strap assemblies each of which has a pair of pivotally interconnected components with each of the components including means adjustably and detachably securing the components to the opposite side surfaces of the horesehead so that the components may be positioned in various orientations to facilitate maintenance and repair as well as manipulation of the horsehead thereby greatly enhancing the safety of personnel engaged in various activities relating to oil well pump jack horsehead repair and manipulation.

DESCRIPTION OF THE PRIOR ART

Conventional oil well pumping units or pump jacks utilize a horsehead attached to one end of a walking beam for vertically reciprocating a pump rod with the horsehead having an arcuate outer face engaged with a wire line assembly or wire rope bail attached thereto and connected with the polished rod. During normal operation and maintenance, it frequently becomes necessary to disconnect the horsehead from the walking beam, make repairs and re-install the horsehead, pivot the horsehead to a folded back position to enable the polished rod, pump rods or pump and production tubing to be pulled out of the well and to perform other operations which require manipulation of the horsehead. The horsehead is quite heavy and difficult to handle. Also, the wire rope line frequently will become disengaged with the arcuate face of the horsehead even though it may have grooves or tracks therein especially if the pump rod breaks. Some efforts have been made to retain the wire line assembly in place and provide a handle on the horsehead. An example of this type of construction is a generally U-shaped member having the free ends of the legs thereof secured to the opposite side surfaces of the horsehead and the bight portion thereof positioned in parallel spaced relation to the arcuate face of the horsehead adjacent the lower end thereof. This type of construction is used on Lufkin pumping units manufactured by Lufkin Foundry and Machine Co., Lufkin, Tex.

SUMMARY OF THE INVENTION

An object of the present invention is to provide a safety attachment for an oil well pump jacket horsehead which enables personnel to more effectively manipulate or handle the horsehead during normal maintenance, repair and operation of the pumping unit or downhole pump.

Another object of the invention is to provide an attachment for oil well pumping units which retain the wire line assembly or wire rope bail properly associated with the arcuate face of the horsehead mounted on the end of the walking beam of a conventional oil well pumping unit.

Still another object of the invention is to provide an attachment for the horsehead of an oil well pumping unit which includes a pair of spaced parallel strap assemblies constructed of metallic bars or straps with each strap assembly including two strap components hingedly interconnected so that the end portions of the strap assemblies may be angularly oriented, extend along opposite side surfaces of the horsehead and be adjustably and detachably connected thereto for orientation of the strap assemblies in various positions.

Another important object of the invention is to provide an attachment in accordance with the preceding object in which the pivotally interconnected ends of the strap components are disposed outwardly of the arcuate face of the horsehead and interconnected by a pivot bolt and spindle thereon which serves to retain the cables of the wire line assembly properly associated with the arcuate face of the horsehead and also provides a handle for facilitating manipulation of the handling of the horsehead such as when it is being removed from the walking beam, attached to the walking beam, folded back over the walking beam or during any other manipulation of the horsehead.

A further significant object of the invention is to provide a safety attachment for the horsehead of an oil well pumping unit which is quite simple in construction, easy to assemble and disassemble, easy to position in various orientations for enabling various operations to be more effectively and safely performed and which will not adversely affect normal operation of the oil well pumping unit.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a perspective view of the safety attachment of the present invention disassembled from the horsehead with the components forming the strap assemblies being disposed in alignment.

FIG. 4 is a fragmental sectional view taken substantially upon a plane passing along section line 4—4 of FIG. 3 illustrating further structural details of the structure for connecting the strap assemblies.

FIG. 5 is a schematic view illustrating the manner in which the safety attachment is used when the horsehead is being installed on the walking beam.

FIG. 6 is a schematic view illustrating the manner in which the safety attachment may be used when the horsehead is folded back over the end of the walking beam while working on the oil well well head assembly, stuffing box or removing the pump rod or pump from the well.

FIG. 7 is a schematic view of the safety attachment illustrating the manner in which it is used when the horsehead is being removed from the walking beam.

DESCRIPTION OF THE PREFERRED EMBODIMENT

Figure 1:
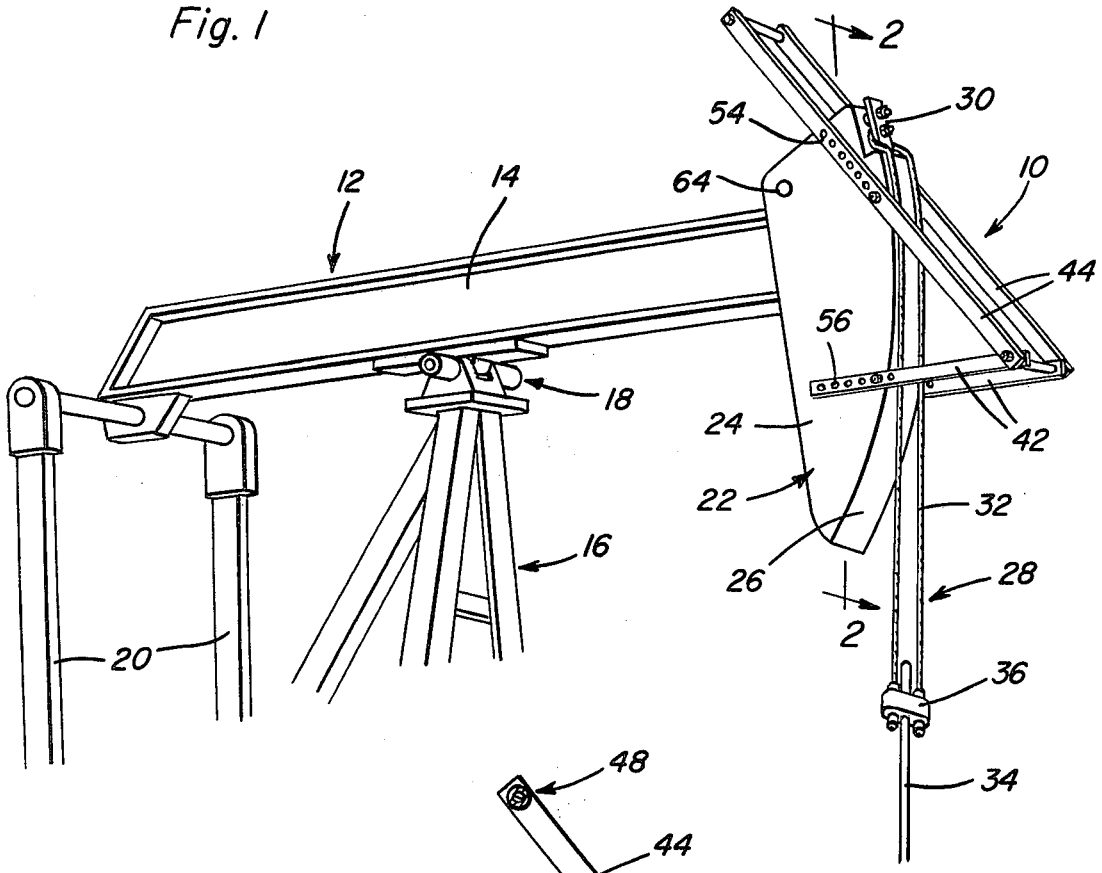
FIG. 1 is a perspective view of the safety attachment of the present invention attached to the horsehead on a conventional oil well pumping unit.

Referring now specifically to the drawings, the safety attachment of the present invention is generally designated by numeral 10 and is associated with a conventional oil well pumping unit generally designated by numeral 12 which includes a walking beam 14 pivotally supported by a samson post 16 for pivotal movement about a generally horizontal axis defined by a center bearing assembly or saddle bearing 18. The beam has a pitman assembly or crank rods 20 connected to one end by virtue of which the beam 14 is oscillated or pivoted in a vertical plane about a transverse horizontal axis. The other end of the beam 14 has a horsehead 22 connected thereto which is of conventional construction and includes a pair of side plates 24 and an arcuate outer face or plate 26. A wire line assembly 28, sometimes called a wire rope bail is attached to the horsehead by a conventional wire line hanger 30 at the upper end of the arcuate member 26 with the cables or wire lines 32 engaged by the arcuate member 26 during swinging movement thereof to maintain the line of force exerted by the wire line assembly 28 in proper alignment with a polished rod 34 so that it will properly reciprocate a sucker rod or pump rod associated with a downhole pump (not shown). The cable 32 is connected to the polished rod by a carrier bar and polished rod clamp 36 in a conventional and well-known manner. All of the aforementioned structure except for the attachment 10 is conventional and forms no particular part of the present invention except for the association of the attachment 10 therewith.

The safety attachment 10 includes a pair of strap assemblies 38 and 40 each of which includes a pair of longitudinally elongated straps or bars 42 and 44 in which the members or components 44 are longer than the members or components 42 with the overlapping ends of the members 42 and 44 being interconnected by a pivoting and spacing assembly 46. The ends of the components 44 remote from the components 42 is provided with a spacing assembly 48 which is identical to the pivoting and spacing assembly 46 and, as illustrated in FIG. 4, includes a tubular spool 50 and an elongated bolt 52 extending therethrough and extending through the components 44. The spool 50 forms a spacer between the components 44 and the bolt 52 retains the components 44 is assembled, parallel relation inasmuch as the pivoting and spacing assembly 46 is of identical construction except that the spool 50 is slightly less in length since the components 42 are disposed interiorly of the components 44 where they overlap thus retaining the components 44 parallel to each other and the components 42 parallel to each other.

Intermediate the length of the components 44, a plurality of longitudinally spaced apertures 54 with the apertures in one component 44 being in alignment with the apertures in the other component 44. The end of the components 42 remote from the pivoting and spacing assembly 46 is provided with a plurality of longitudinally spaced and aligned apertures 56 therein.

Figure 2:
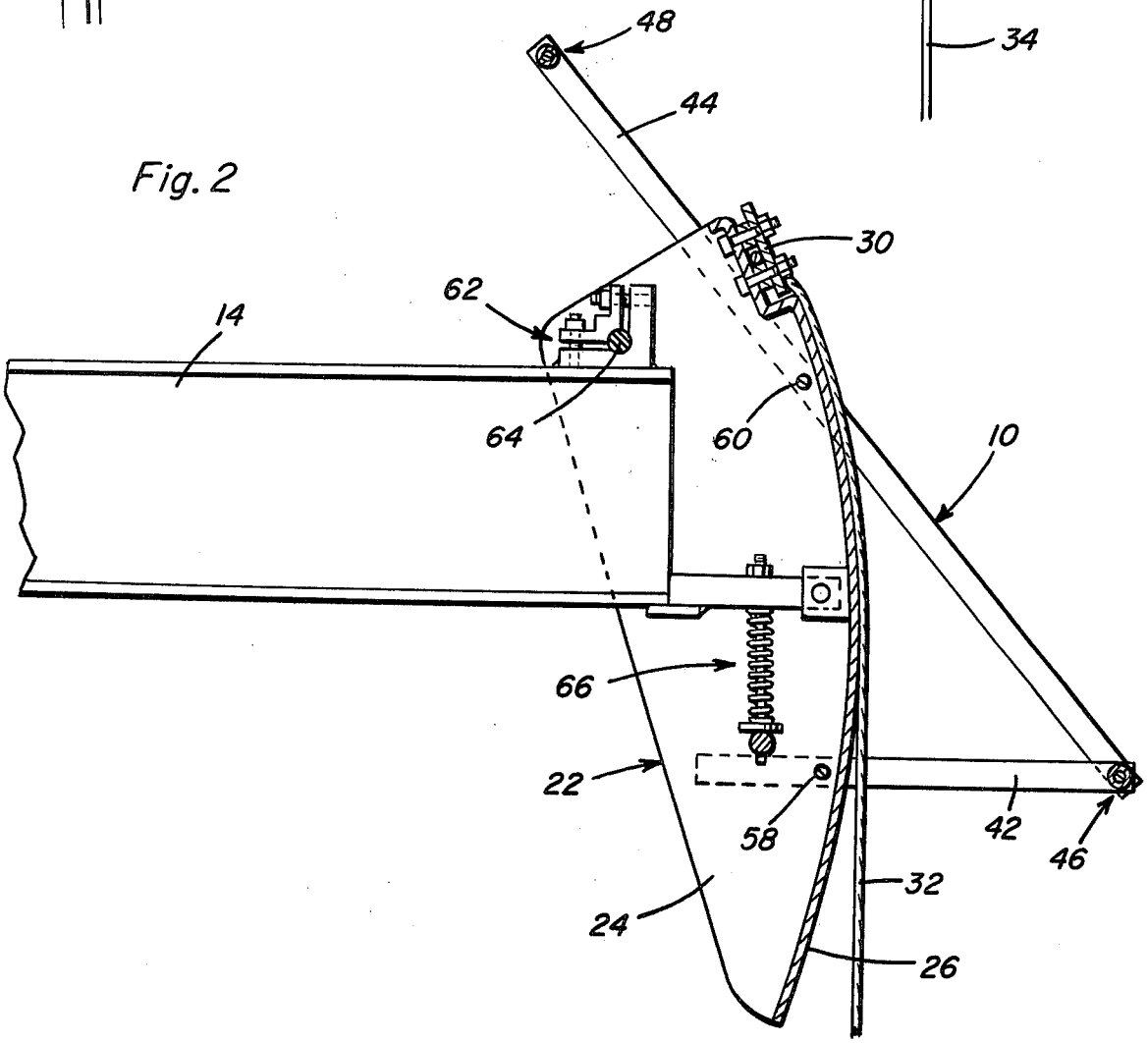
FIG. 2 is a vertical sectional view taken substantially upon a plane passing along section line 2—2 of FIG. 1 illustrating the structural details of the attachment and the association of the attachment with the horsehead and walking beam.

When the oil pumping unit 12 is operating normally, the safety attachment 10 is associated with the horsehead 22 in the manner illustrated in FIGS. 1 and 2, that is, with the shorter components 42 being generally horizontally disposed and the apertured end thereof engaging the outer side surfaces of the side plates 24 and being adjustably and detachably connected thereto and also pivotally connected thereto by a fastening bolt 58. The longer components 44 are disposed in acute angular relation to the shorter components 42 and extend alongside of the opposite side surfaces of the side plates 24 with the apertures 54 enabling detachable and pivotal engagement of the components 44 with the horsehead 22 by the use of an elongated pivot bolt 60. When oriented in this manner, the pivoting and spacing assembly 46 at the overlapping juncture between the components 42 and 44 is disposed outwardly of but parallel to the lower portion of the arcuate member 26 so that the spool 50, in effect, forms a handle to enable manipulation and control of the horsehead by a person on the ground. Also, in this orientation, the spacing assembly 48 at the upper ends of the components 44 is generally parallel to the pivot axis for the walking beam and provides a handle by which the horsehead may be manipulated by a person on the beam or provides a handle to enable a person on the beam to steady himself when performing various operations that may become necessary during normal pumping operations.

Frequently, the horsehead 22 is removed from or attached to the walking beam 14 and for this purpose, the outer upper end of the walking beam 14 is provided with a saddle bearing assembly 62 receiving a trunnion 64 extending between the side plates forming the horsehead. A conventional latch structure 66 is provided to retain the horsehead in proper relation to the walking beam which can be released to enable the horsehead to be pivoted upwardly to an overlying position of the walking beam as illustrated in FIG. 6 which also represents conventional construction insofar as the walking beam and horsehead is concerned.

When installing the horsehead 22, as illustrated in FIG. 5, one person usually is on the beam 14 and a hoisting device such as a crane having a lift cable or chain 68 is employed to lift the horsehead into position. In view of the weight of the horsehead, the person on the beam 14 finds it quite difficult to align the trunnion 64 with the bearing assembly or bracket 62 and place the retaining caps on the bearing at the same time. The attachment 10 of the present invention can be used by a person on the ground by orienting the components 42 and 44 of the strap assemblies 38 and 40 in alignment and in downwardly extending relation with the bolt 58 securing the strap assemblies to the horsehead. By a person on the ground engaging the spacing assembly 48 by using his hand or hands 70, various forces can be exerted on the horsehead including movement inwardly and outwardly of the beam 14 and pivoting or swinging of the horsehead about a vertical axis and also lateral movement of the horsehead in relation to the beam thereby accurately aligning the trunnion with the saddle bearing or bracket 62 so that the person on the beam can more easily install the horsehead with less danger of injury.

FIG. 7 illustrates similar arrangement in which the beam is at its lowermost point and the horsehead is being removed therefrom in which event the safety attachment 10 is generally oriented in a horizontal direction or possibly a downwardly inclined direction with the safety attachment 10 stabilizing the horsehead in relation to the beam so that the person on the beam removing the retaining caps on the saddle bearing is not faced with the danger of the horsehead being moved toward him thus tending to knock him off the beam even though the horsehead may be supported by a crane or the like.

FIG. 6 illustrates the horsehead 21 in a position where it has been folded upwardly and into generally overlying relation to the beam 14 which is a common position when the pump rod or polished rod has to be elevated such as when the well is shutdown and the pump is pulled from the well. In this arrangement, the safety attachment 10 is oriented with the components in alignment and the person on the beam may effectively pivot the horsehead into its upwardly folded or pivoted position. It is noted that when this occurs or whenever the horsehead is being manipulated or handled, the wire line assembly 28 is retained in properly oriented relation to the arcuate face. Also, during normal pumping operations, the safety attachment 10 will retain the wire line assembly in proper relation to the arcuate face of the horsehead and serve to keep the cables 32 in the cable tracks in the arcuate face of the horsehead. Also, in the event the pump rod or polished rod breaks, the safety attachment will prevent the cables from moving laterally alongside of the outer faces of the side plates 24 defining the horsehead. This prevents the polished rod from being bent when the sucker rods or pump rods part since the wire line assembly 28 will be maintained in position so that a straight line pull will be maintained on the polished rod. The elongated length of the safety attachment provides sufficient lever arm to enable the horsehead to be controlled during removal and installation and provides a safety factor for the polished rod to prevent bending thereof in the event the pump rods separate. If desired, cap screws or short bolts may be employed rather than elongated through bolts for connecting the bars or straps to the horsehead and the spools can be easily cut to length and installed and the multiple apertures enable the device to be installed on various horseheads and in various angular relations. The components 42 and 44 may be standard structural metal components of rectangular configuration thus enabling the device to be constructed in a simple and inexpensive manner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an oil well pumping unit comprising a walking beam oscillatable in a vertical plane about substantially a horizontal axis, a horsehead on one end of the beam and including a pair of side plates and an arcuate plate defining the face of the horsehead, a wire line assembly connected to the upper end of the arcuate face of the horsehead and connected to a polished rod at the lower end thereof, that improvement comprising an attachment for retaining the wire line assembly in overlying relation to the arcuate face to prevent bending of the polished rod during an upward movement of the horsehead in the event the polished rod does not move to its lowest position during a previous downward movement, said attachment comprising a pair of laterally spaced strap assemblies with each strap assembly including a pair of angularly disposed components connected together by a transverse spacing and pivoting assembly oriented in spaced, generally parallel relation to the arcuate face of the horsehead, means securing the free end portions of the components to the side plates of the horsehead to prevent the wire line assembly from falling off the edges of the arcuate face of the horsehead.

2. The combination as defined in claim 1 wherein each of said components includes a plurality of longitudinally spaced apertures therein, bolt means extending through said apertures for adjustably and detachably securing the components to the horsehead.

3. The combination as defined in claim 2 wherein the free end portions of one pair of components being interconnected by a spacing assembly to define a handle when the components are in aligned relation when said one pair of components has been disconnected from the horsehead and extended outwardly beyond the arcuate face thereby enabling a person on the ground to manipulate the horsehead during installation and removal in relation to the walking beam thereby enabling a person on the walking beam to more expediently assemble the horsehead on the walking beam and remove the horsehead from the walking beam when the horsehead is suspended by a flexible lift element.

4. The combination as defined in claim 3 wherein said strap assemblies extend outwardly beyond the arcuate face of the horsehead at vertically spaced points thereon during normal pumping operation to more effectively retain the wire line assembly with the arcuate face in the event of slack in the wire line assembly such as caused by separation of the pump rod.

* * * * *